United States Patent [19]

Morishita et al.

[11] Patent Number: 4,520,376

[45] Date of Patent: May 28, 1985

[54] HEAT-SENSITIVE RECORDING SHEET

[75] Inventors: Sadao Morishita, Ibaraki; Toshihiko Matsushita, Funabashi, both of Japan

[73] Assignee: Mitsubishi Paper Mills, Ltd., Tokyo, Japan

[21] Appl. No.: 515,528

[22] Filed: Jul. 20, 1983

[30] Foreign Application Priority Data

Jul. 22, 1982 [JP] Japan ..... 57-126730

[51] Int. Cl.[3] ..... B41M 5/18

[52] U.S. Cl. ..... 346/204; 346/208; 346/214; 346/215; 427/150; 427/151; 428/402.24

[58] Field of Search ..... 428/320.4–320.8, 428/411, 488, 537, 913, 914, 402.2, 402.21, 402.22, 402.24; 282/27.5; 346/204, 208, 214, 215; 427/150, 151

[56] References Cited

FOREIGN PATENT DOCUMENTS 7400070 5/1974 Japan ..... 346/204

0051490 3/1982 Japan ..... 346/215

*Primary Examiner*—Bruce H. Hess

*Attorney, Agent, or Firm*—Cushman, Darby & Cushman

[57] ABSTRACT

A heat-sensitive recording sheet consisting of a support and a coating layer comprising microcapsules each containing therein at least a colorless dye precursor as color former, a color developer and a waxy substance being solid at the normal temperature and melting when heated, gives good image retention over a long period of time, has superior chemical resistance and causes no trailing or sticking to a thermal head when recording is made thereon with a heat-sensitive facsimile or a heat-sensitive printer.

6 Claims, No Drawings

HEAT-SENSITIVE RECORDING SHEET

This invention relates to a heat-sensitive recording sheet and particularly to a single color or multicolor heat-sensitive recording sheet of high sensitivity being good in image retention over a long period of time and excellent in chemical resistance and causing no trailing or sticking when recording is made thereon with a heat-sensitive facsimile or a heat-sensitive printer.

Dye color-developing type heat-sensitive recording sheets being in wide practical use are now produced by (a) dispersing a colorless dye precursor, a color developer which causes said dye precursor to develop a color when heated, and a wax as color-developing aid, in fine particles, (b) adding thereto an organic or inorganic oil-absorbing pigment, a binder, a surfactant, a fluorescent dye and the like to prepare a heat-sensitive coating color, and (c) coating the color on a support and drying the coated support. These heat-sensitive recording sheets are required to have characteristics such as:

- High sensitivity recording is made by a heat-sensitive facsimile or a heat-sensitive printer.
- Formed images are stable and retained over a long period of storage under natural conditions.
- No white powder is formed on images.
- No color disappearance or discoloration of images occurs when these images come in contact with chemicals.
- The background has a white color.
- There occurs no trailing or stacking during recording.

Heat-sensitive recording sheets currently in wide use do not sufficiently satisfy the above requirements. For example, as the sensitivity of these heat-sensitive recording sheets increases, blooming or powdering, trailing and the like appear more frequently. Further, color disappearance or discoloration of images occuring due to their contact with chemicals can hardly be prevented in the case of a recording sheet wherein a heat-sensitive recording layer is coated on a support in a single layer, and this phenomenon is currently being dealt with by overcoating a high molecular substance on said-high sensitive recording layer (Japanese Laid-Open Patent Application No. 12834/1979), however, this requires multiple coating and consequently a higher production cost.

The heat-sensitive recording sheet according to this invention solves all these drawbacks of conventional heat-sensitive recording sheets and further enables color development in multicolor by using at least two kinds of microcapsules each containing a different dye precursor which produces a different color and by controlling the temperature of the heat-sensitive head of a printer.

Heat-sensitive recording sheets being able to give a multicolor with only a single sheet are described, for example, in Japanese Laid-Open Patent Application No. 69738/1974, Japanese Laid-Open Patent Application No. 65239/1974, Japanese Patent Publication No. 27708/1974, Japanese Laid-Open Utility-Model Application No. 81065/1980 and so forth. In production of these sheets, either multilayer coating or multistep local coating is used.

The process of producing the heat-sensitive recording sheet of this invention differs from conventional processes of producing the multicolor heat-sensitive recording sheets, in that a multicolor heat-sensitive recording sheet can be produced only with one time coating (single coating) and microcapsules are used.

The process of producing the heat-sensitive recording sheet of this invention will be explained in detail below.

Microcapsules of this invention must contain therein at least (a) a colorless dye precursor as color former, (b) a color developer and (c) a waxy, color-developing aid being solid at the normal temperature and melting when heated. As the colorless dye precursor as color former, there are mentioned, for example, Crystal Violet Lactone, 3-indolino-3-p-dimethylaminophenyl-6-dimethylaminophthalide, 3-diethylamino-7-chlorofluoran, 3-diethylamino-7-cyclohexylaminofluoran, 3-diethylamino-5-methyl-7-t-butylfluoran, 3-diethylamino-6-methyl-7-anilinofluoran, 3-diethylamino-6-methyl-7-p-butylanilinofluoran, 2-(N-phenyl-N-ethyl)aminofluoran, 3-diethylamino-7-dibenzylaminofluoran, 3-cyclohexyl-amino-6-chlorofluoran, 3-diethylamino-6-methyl-7-xylidinofluoran, 2-anilino-3-methyl-6-(N-ethyl-p-toluidino)fluoran, 3-pyrrolidino-6-methyl-7-anilinofluoran, 3-pyrrolidino-7-cyclohexylaminofluoran, 3-pyperidino-6-methyl-7-toluidinofluoran, 3-pyrrolidino-6-methyl-7-(p-toluidino)fluoran, 3-pyperidino-6-methyl-7-anilinofluoran, 3-N-methylcyclohexylamino-6-methyl-7-anilinofluoran, 3-diethylamino-7-(m-trifluoromethylanilino)fluoran and the like. Of course, other dye precursors may be used.

As the color developer usable in this invention, there are, for example, 4-phenylphenol, 4-hydroxyacetophenon, 2,2'-dihydroxydiphenyl, 2,2'-methylenebis(4-chlorophenol), 2,2'-methylenebis(4-methyl-6-t-butylphenol), 4,4'-isopropylidenebis(2-methylphenol), 4,4'-ethylenebis(2-methylphenol), 1,1'-bis(4-hydroxyphenyl)-cyclohexane, 2,2-bis(4'hydroxyphenyl)propane, 4,4'-cyclohexylidenebis(2-isopropylphenol), novolak type phenolic resin, 3,5-di-t-butylsalicylic acid, 3,5-di-α-methylbenzylsalicylic acid, 3-methyl-5-t-butylsalicylic acid, phthalic acid monoanilide, p-ethoxybenzoic acid, p-benzyloxybenzoic acid, benzyl p-hydroxybenzoate and the like. Of course, other color developers may be used.

As the waxy, color-developing aid usable in this invention, there are, for example, animal waxes such as beeswax, spermaceti, Chinese insect wax, lanolin and the like; vegetable waxes such as candelilla wax, carnauba wax, Japan wax, rice wax, sugar cane wax and the like; mineral waxes such as montan wax, ozokelite, ceresine, lignite wax and the like; petroleum waxes such as paraffin wax, microcrystalline wax and the like; modified waxes such as montan wax derivative, paraffin wax derivative, microcrystalline wax derivative and the like; hydrogenated waxes such as castor wax, opal wax and the like; low molecular weight polyethylene and its derivative; synthetic waxes such as Acra wax, distearylketone and the like; saturated fatty acid amide waxes such as capronamide, caprylamide, pelargonamide, capramide, lauramide, tridecylamide, myristamide, stearamide, behenamide, ethylenebisstearamide and the like; unsaturated fatty acid amide waxes such as caproleamide, myristoleamide, oleamide, elaidamide, linolamide, erucamide, ricinoleamide, linoleamide and the like; and higher resin acids. They can be used alone or in combination. Of course, other compounds may be used.

Microcapsules of this invention can be produced by any of known methods such as the complex coacervation method, the in situ method and the interfacial polymerization method.

The point needing attention in microcapsule production is how to produce microcapsules without causing color development. In general, when a colorless dye precursor as color former and a color developer are contained in the same microcapsule, they are liable to develop a color during microcapsule production. As a method to solve this problem, there is a technique in the field of pressure-sensitive recording sheets wherein a volatile desensitizer is contained in microcapsules and this desensitizer vaporizes into the air when the microcapsules are broken by pressure and thereby a colorless dye precursor as color former and a color developer are caused to develop a color (Japanese Laid-Open Patent Application No. 82919/1973). However in the field of heat-sensitive recording sheet, such a color-developing mechanism by capsule breakage is not utilized, and it is required that color development occurs in microcapsules only when these microcapsules are heated without capsule breakage.

The present inventors made studies on an additive to be contained in microcapsules which does not cause color development during microencapsulation and also even when microcapsules are pressurized but which does cause color development only when microcapsules are heated. As a result, aforementioned waxy substances which are solid at the normal temperature and melt when heated, have been found to be effective as such an additive.

Various investigations were made on specific processes of encapsulation and, as a result, the following process has been found to be effective because it causes no color development during encapsulation.

Firstly, a colorless dye precursor as color former and a color-developing aid are melted together followed by being emulsified as finely as possible (Step 1). Then, a color developer and a color-developing aid are melted together followed by being emulsified as finely as possible (Step 2). Two emulsions obtained in Step 1 and Step 2 are mixed and therein is added an emulsifier necessary for encapsulation (Step 3). Therein is further poured a melted color-developing aid and an emulsion having particle diameters of several microns is obtained (Step 4). The emulsion wherein there are mixed a colorless dye precursor, a color developer and a color-developing aid is obtained. Next, a capsule wall-forming agent and other additives are added and the whole mixture is stirred at a predetermined temperature to obtain a coating color containing microcapsules.

It is supposed that in the microcapsule-containing coating color thus obtained there exist, as impurities, microcapsules containing a co-melt of a colorless dye precursor and a color-developing aid, microcapsules containing a co-melt of a color developer and a color-developing aid and microcapsules containing only a color-developing aid, to some extent. These microcapsules as impurity cause no oozing of contents out of microcapsules and accordingly no color development when heated, and therefore do not impair the characteristics of the heat-sensitive recording sheet of this invention. Microcapsules containing a colorless dye precursor as color former, a color developer and a color-developing aid develop a color inside themselves when heated.

In the process of encapsulation, each of the emulsions obtained in afore-mentioned step (1) and step (2) need not be a co-melt with a color-developing aid. Instead, they may be particles in the form of a powdery dye precursor or color developer coated with a color-developing aid.

There is another process of encapsulation. A colorless dye precursor as color former and a color-developing aid are melted together and then emulsified as finely as possible. By using a known microencapsulation process, there are prepared pseudo-microcapsules having a very thin shell thickness compared with ordinary shell thicknesses (Step I). Shells of these pseudo-microcapsules are very thin and barely forms a film, and may be somewhat porous. Next, a color developer and a color-developing aid are melted together and emulsified as finely as possible, and then in the same manner as in step (I), pseudo-microcapsules are prepared (Step II). Two kinds of pseudo-microcapsules thus obtained in steps (I) and (II) are mixed, and to the resulting dispersion of these two kinds of pseudo-microcapsules is added an emulsifier necessary for encapsulation and emulsification. To the resulting emulsion, is added a capsule wall-forming agent and the whole mixture is stirred at a predetermined temperature, whereby microcapsules are formed (Step III). Thus, there is obtained a coating color containing microcapsules containing two kinds of pseudo-microcapsules prepared in step (I) and step (II) and each having a very thin shell film. In microcapsules present in the coating color obtained, a colorless dye precursor as color former and a color developer are contained in respective pseudo-microcapsules each having a very thin shell film, and accordingly do not develop a color at the normal temperature because they are separated from each other by the very thin films. Only when heated, the dye precursor and the color developer cause color development inside microcapsules because the very thin films covering pseudo-microcapsules are broken and the dye precursor and the color developer come in contact in microcapsules through a color-developing aid.

When microcapsules containing two kinds of pseudo-microcapsules prepared in step (I) and step (II) are formed in step (III), it is desirable viewed from the effect of color development that these pseudo-microcapsules be contained in microcapsules in a coagulated form like a cluster of grapes. Also it is advantageous from the standpoint of heat sensitivity that the wall films of pseudo-microcapsules be made of a thermoplastic resin.

There is still another process of encapsulation. A finely dispersed, solid, colorless dye precursor as color former is contained, by the use of a known microencapsulation process, in pseudo-microcapsules having a very thin film thickness compared with ordinary film thicknesses (Step i). Next, in the same manner as in step (i), a finely dispersed solid color developer is contained in pseudo-microcapsules (Step ii). Two kinds of pseudo-microcapsules prepared in step (i) and step (ii) are mixed and then dispersed in a molten color-developing aid (Step iii). To this dispersion is added an emulsifier and emulsification is carried out. Then, a film-forming agent is added thereto and the whole mixture is stirred at a predetermined temperature whereby microcapsules are formed (Step iv). In the microcapsules formed, pseudo-microcapsules containing a colorless dye precursor as well as pseudo-microcapsules containing a solid color developer are surrounded by a color-developing aid, and no color is developed at the normal temperature but, when heated, the wall films of the pseudo-microcapsules are broken and a color is developed by the action of the color-developing aid present as a medium outside the pseudo-microcapsules.

The proportion of (a) a colorless dye precursor as color former, (b) a color developer and (c) a color-developing aid is suitably 1 to 10 parts by weight of (b) and 1 to 10 parts by weight of (c) relative to 1 part by weight of (a). The proportion is determined by the melting points and the color-developing abilities of (a), (b) and (c).

Next, a process for coating a support with the above-obtained coating color containing microcapsules will be explained.

In microcapsules of this invention, a color is developed within microcapsules when heated. But, a colored substance does not ooze out of the microcapsule film and hence an oil-absorbing organic or inorganic pigment as used in heat-sensitive recording sheets currently in wide use is not necessarily required. Just mixing of a microcapsule-containing coating color and a binder giving a low level of sticking to a thermal head followed by coating the mixture on a support and drying is sufficient. As the usable binder, most binders having adhesivity can be used. They are, for example, polyvinyl alcohols or their modified products, starch or its modified product, polyacrylamides, casein, styrene-maleic anhydride resin, isobutylenemaleic anhydride resin, carboxymethyl cellulose, hydroxyethyl cellulose, carboxymodified polyethylenes, styrene butadiene latex, carboxymodified styrene butadiene latex and so forth.

It is also possible that the microcapsule-containing coating color of this invention be spray-dried, then to the resulting powder-like microcapsules be added an appropriate additive and the resulting printing ink be printed on a support.

As the support, a paper is generally used. The support may also be a film, a synthetic paper, a metal foil or their composite sheet.

When the microcapsule-containing coating color is coated on a support, a dispersant and/or a surfactant may also be used so as to give improved stability.

Hereinafter, this invention will be explained specifically by referring to Examples.

EXAMPLE 1

Production of microcapsules which develop a color at low temperatures

3 Parts by weight of 3-diethylamino-6-methyl-7-anilinofluoran and 6 parts by weight of oleamide (m.p. 70° to 75° C.) were melted together by heating. The co-melt, while hot, was poured into 50 parts by weight of an aqueous solution dissolving 0.5% of methyl cellulose of the normal temperature. The mixture was emulsified so as to give particle diameters of 1 to 2 μ, by the use of a TK-homomixer (manufactured by Tokushu Kika Kogyo K. K.) to obtain an emulsion A. Separately, 3 parts by weight of benzyl-p-hydroxybenzoate and 6 parts by weight of oleamide were melted together by heating. The resulting co-melt still being hot was poured into 50 parts by weight of an aqueous solution dissolving 0.5% of methyl cellulose of the normal temperature. The mixture was emulsified so as to give particle diameters of 1 to 2 μ by the use of the TK-homomixer to obtain an emulsion B.

20 parts by weight of the emulsion A and 50 parts by weight of the emulsion B were placed in a beaker and they were thoroughly stirred to obtain an emulsion C. The emulsion C was added to 100 parts by weight of an aqueous solution of pH 4.0 dissolving 5% of styrene-maleic anhydride copolymer as emulsifier and a small quantity of sodium hydroxide, and emulsification was further conducted. Thereto was added 15 parts by weight of molten oleamide and emulsification was conducted with vigorous stirring. The emulsion consisted of particles of the color former and oleamide, particles of the color developer and oleamide, and oleamide. When emulsion particles had diameters of 4 to 5 μ, emulsification was terminated. Separately, 8 parts by weight of melamine, 20 parts by weight of 37% aqueous formaldehyde solution, and 52 parts by weight of water were mixed and, after adjusting its pH to 9.0 with sodium hydroxide, were heated to 60° C. In 15 min, the mixture became transparent and a melamine-formaldehyde precondensate was obtained. This precondensate was added to the above emulsion being stirred and they were reacted for 2 hr with the mixture temperature being kept at 70° C. The obtained microcapsules did not develop a color and was milky white.

Subsequently, there was prepared a coating color (solid content 25% by weight) containing 10 parts by weight (as solid) of the microcapsules and 2 parts by weight of a polyvinyl alcohol as binder. The coating color was coated on a base paper of 50 g/m$^2$ by the use of a Meyer bar so that the coated quantity became 7.5 g/m$^2$ (as solid).

On the coated sheet obtained, recording was made by the use of a heat-sensitive facsimile, whereby a clear black image was obtained.

When ethanol was coated on the image developed, there was no image spreading or discoloration. When dioctyl phthalate (plasticizer) was coated, there was no image disappearance. Also, when non-heated portions were pressurized, there was no color development.

COMPARATIVE EXAMPLE 1

2 Parts by weight of 3-diethylamino-6-methyl-7-anilinofluoran and 0.2 part by weight (0.02 part by weight as solid) of 10% polyvinyl alcohol as binder were mixed and dispersed to obtain a dispersion containing a color former.

5 Parts by weight of benzyl p-hydroxybenzoate and 0.5 part by weight (0.05 part by weight as solid) of 10% polyvinyl alcohol as binder were mixed and dispersed to obtain a dispersion containing a color developer.

2 Parts by weight of oleamide and 0.2 part by weight (0.02 part by weight as solid) of 10% polyvinyl alcohol were mixed and dispersed to obtain a dispersion containing a color-developing aid.

These three dispersions were mixed with 20 parts by weight (2 parts by weight as solid) of 10% polyvinyl alcohol to obtain a heat-sensitive coating color.

The heat-sensitive coating color was coated on a base paper of 50 g/m$^2$ by the use of a Meyer bar so that the coated quantity became 5.5 g/m$^2$ as solid.

On the coated sheet obtained, recording was made by the use of a heat-sensitive facsimile, whereby a black image was obtained.

When ethanol was coated on the image developed, the whole image portion became black in a short period of time and the image became obscure and unrecognizable. When dioctyl phthalate was coated, the image became white and disappeared in a short period of time. Further, when the non-heated portions were pressurized, a color developed.

EXAMPLE 2

(1) Microcapsules were formed and a microcapsule-containing coating color was obtained in the same manner as in Example 1, except that 3-diethylamino-6-methyl-7-anilinofluoran in Example 1 was replaced by Crystal Violet Lactone.

(2) Microcapsules were formed and another kind of microcapsule-containing coating color was obtained in the same manner as in Example 1, except that 3-diethylamino-6-methyl-7-anilinofluoran and oleamide in Example 1 were replaced by 3-diethylamino-6-methyl-7-chlorofluoran and lauramide (m.p. 80° to 90° C.), respectively.

(3) A coating color (solid content 25% by weight) consisting of 5 parts by weight (as solid) of the microcapsule-containing coating color obtained in (1), 5 parts by weight (as solid) of the microcapsule-containing coating color obtained in (2) and 2 parts by weight of a polyvinyl alcohol as binder, was prepared. It was coated on a base paper of 50 g/m$^2$ by the use of a Meyer bar so that the coated quantity became 7.5 g/m$^2$ as solid.

On the coated sheet obtained, high temperature recording was made by the use of a heat-sensitive facsimile, whereby an image of violet color which is an intermediate color between blue and red was obtained. Low temperature recording was also made likewise, whereby an image of blue color developed.

Both images did not cause discoloration and fading when ethanol or dioctyl phthalate was coated on these images. When the non-heated portions were pressurized, there occured no color development.

EXAMPLE 3

3 Parts by weight of Crystal Violet Lactone and 6 parts by weight of stearamide (m.p. 97° to 102° C.) were melted by heating. The co-melt still being hot was poured into 50 parts by weight of an aqueous solution dissolving 0.5% of methyl cellulose of the normal temperature. The mixture was emulsified by the use of the TK-homomixer so as to give particle diameters of 1 to 2 $\mu$ to obtain an emulsion D. Separately, 3 parts by weight of benzyl p-hydroxybenzoate and 6 parts by weight of stearamide were melted by heating. The co-melt still being hot was poured into 50 parts by weight of an aqueous solution dissolving 0.5% of methyl cellulose of the normal temperature. The mixture was emulsified by the use of the TK-homomixer so as to give particle diameters of 1 to 2 $\mu$, whereby an emulsion E was obtained.

The emulsion D was added to 30 parts by weight of an aqueous solution of pH 4.0 dissolving 5% of a styrene-maleic anhydride copolymer and a small quantity of sodium hydroxide, and emulsification was further conducted. Separately, 2 parts by weight of melamine, 5 parts by weight of 37% aqueous formaldehyde solution and 13 parts by weight of water were mixed and its pH was adjusted to 9.0 with sodium hydroxide. Then, the mixture was heated to 60° C., whereby a melamine-formaldehyde precondensate was formed. This precondensate was added to the above reemulsified emulsion D. They were stirred at 70° C. for reaction, whereby pseudo-microcapsules were formed. The similar procedure was conducted for the emulsion E.

Then, 20 parts by weight of pseudo-microcapsules-containing emulsion D and 40 parts by weight of pseudo-microcapsules-containing emulsion E were mixed thoroughly and the resulting mixture was added to 100 parts by weight of 5% aqueous styrene-maleic anhydride copolymer solution of pH 4.0 and they were emulsified with stirring.

To the resulting emulsion was added a melamine-formaldehyde precondensate obtained by (a) mixing 8 parts by weight of melamine, 20 parts by weight of 37% formaldehyde and 52 parts by weight of water, (b) adjusting the pH of the resulting mixture to 9.0 with sodium hydroxide and (c) heating it to 60° C. They were reacted for 2 hr at 70° C.

Microcapsules in the coating color obtained comprised pseudo-microcapsules containing the color former and stearamide and pseudo-microcapsules containing the color developer and stearamide.

Subsequently, there was prepared a coating color (solid content 25% by weight) consisting of 10 parts by weight (as solid) of the microcapsules obtained above and 2 parts by weight of a polyvinyl alcohol as binder. The coating color was coated on a base paper of 50 g/m$^2$ by the use of a Meyer bar so that the coated quantity became 7.5 g/m$^2$ as solid. On the coated sheet obtained, recording was made by the use of a heat-sensitive facsimile, whereby was developed a clear blue image of high sensitivity. The image did not cause discoloration or color fading by contact with ethanol or dioctyl phthalate. Also, the non-heated portions did not develop a color when pressed.

What is claimed is:

1. A heat-sensitive recording sheet consisting of a support and a coating layer comprising microcapsules which are unbreakable when heated for heat-sensitive recording, said microcapsules each containing therein at least a colorless dye precursor as color former, a color developer and a waxy substance being solid at the normal temperature and melting when heated.

2. A heat-sensitive recording sheet according to claim 1, wherein the coating layer comprises at least two kinds of microcapsules each comprising a different colorless dye precursor forming a different color and accordingly can develop a multi color.

3. A heat-sensitive recording sheet according to claim 2 wherein the microcapsules comprise a melamine-formaldehyde condensate.

4. A heat-sensitive recording sheet according to claim 1, wherein the ratio of the dye precursor, the color developer and the waxy substance is 1:1 to 10:1 to 10.

5. A heat-sensitive recording sheet according to claim 4 wherein the microcapsules comprise a melamine-formaldehyde condensate.

6. A heat-sensitive recording sheet according to claim 1 wherein the microcapsules comprise a melamine-formaldehyde condensate.

* * * * *